US006695190B1

(12) United States Patent
Gunter, Jr. et al.

(10) Patent No.: US 6,695,190 B1
(45) Date of Patent: Feb. 24, 2004

(54) TAPE DISPENSING DEVICE

(76) Inventors: Gary Gunter, Jr., 19245 N. 47th La., Glendale, AZ (US) 85308; Dan B. Pool, 12772 E. Turquoise, Phoenix, AZ (US) 85029

( * ) Notice: Subject to any disclaimer, the term of this patent is extended or adjusted under 35 U.S.C. 154(b) by 0 days.

(21) Appl. No.: 09/928,105

(22) Filed: Aug. 10, 2001

Related U.S. Application Data

(60) Provisional application No. 60/224,703, filed on Aug. 11, 2000.

(51) Int. Cl.[7] ..... B26F 3/02

(52) U.S. Cl. ..... 225/47; 225/56; 225/66; 225/79; 225/80; 225/88; 156/527

(58) Field of Search ..... 225/56, 46, 47, 225/51, 79, 58, 26, 66, 80, 88; 156/523, 527; 83/649

(56) References Cited

U.S. PATENT DOCUMENTS 479,554 A * 7/1892 Carpenter ..... 225/61
2,640,656 A * 6/1953 Donkin ..... 225/25
2,706,003 A * 4/1955 Isler ..... 225/22
2,842,201 A * 7/1958 Vogt ..... 225/56
3,051,223 A * 8/1962 Waltz ..... 156/527
3,109,570 A * 11/1963 Maddalena ..... 225/66
3,149,764 A * 9/1964 Waltz ..... 225/57
3,155,301 A * 11/1964 Kusek ..... 225/66
3,187,968 A * 6/1965 Favre ..... 225/56
4,915,769 A * 4/1990 Heil et al. ..... 156/527
5,073,228 A * 12/1991 Lin ..... 156/523
5,792,310 A * 8/1998 Thompson et al. ..... 156/523
5,833,169 A * 11/1998 Morand ..... 242/560

* cited by examiner

*Primary Examiner*—Boyer D. Ashley
*Assistant Examiner*—Thomas J Druan, Jr.
(74) *Attorney, Agent, or Firm*—Parsons & Goltry; Robert A. Parsons; Michael W. Goltry

(57) ABSTRACT

A tape dispenser for receiving a roll of tape and dispensing tape including a frame having a back end and a front end, a spool carried by the frame intermediate the back end and the front end, a retaining arm coupled to the back end of the frame and biased toward the spool for restraining the roll of tape. A flat feed is carried by the frame at the front end for receiving the tape and dispensing the tape in a flat configuration, and a corner feed is carried by the frame at the front end adjacent the flat feed, for receiving the tape and dispensing the tape in a folded configuration.

7 Claims, 4 Drawing Sheets

TAPE DISPENSING DEVICE

CROSS-REFERENCE TO RELATED APPLICATION

This application claims the benefit of Provisional Application Serial No. 60/224,703 filed Aug. 11, 2000.

FIELD OF THE INVENTION

The present invention pertains to tape dispensers.

More particularly, the present invention pertains to tape dispensers for dispensing joint tape.

BACKGROUND OF THE INVENTION

In conventional use, paper joint tape is employed to cover holes or joints in wallboard. The tape is used by first applying a small portion of joint compound or mud to the area, then covering the mud with a strip of tape. The mud holds the tape in position. After drying, additional joint compound or mud is applied to cover and smooth the tape at the hole or joint. Dispensers for dispensing joint tape are well known and have been used for many years. These devices allow tape to be dispensed quickly, easily, and accurately without wrinkling. The dispensers typically consist of a frame carrying a roll of tape. While somewhat effective in its intended role, when a sufficient length of tape has been dispensed, the individual applying the tape must tear it or cut is with a knife against the wallboard. This can be awkward and difficult to accomplish. Furthermore, it requires the use of two hands.

Another limitation of convention tape dispensers is that they can not be employed for taping corners. Joint tape is supplied with a crease so that it can be used on a flat surface or folded at the crease for taping corners. A length of tape must be removed from the dispenser, folded along the crease then applied. This can greatly increase the time required for taping and can be much more difficult to accomplish.

Accordingly, it is an object of the present invention to provide a new and improved joint tape dispensing device.

Another object of the present invention is to provide a tool for quickly and efficiently dispensing tape.

And another object of the present invention is to provide a joint tape dispensing device which will dispense tape for flat surfaces or for corners.

Yet another object of the present invention is to provide a joint tape dispensing device which can be operated with one hand.

A further object of the present invention is to provide a joint tape dispensing device having a cutting element enabling one hand operation.

And a further object of the present invention is to provide a joint tape dispensing device which controls tape dispensing.

SUMMARY OF THE INVENTION

Briefly, to achieve the desired objects of the instant invention in accordance with a preferred embodiment thereof, provided is a tape dispenser for receiving a roll of tape and dispensing tape. The tape dispenser includes a frame having a back end and a front end, a spool carried by the frame intermediate the back end and the front end, a retaining arm coupled to the back end of the frame and biased toward the spool for restraining the roll of tape. A flat feed is carried by the frame at the front end for receiving the tape and dispensing the tape in a flat configuration, and a corner feed is carried by the frame at the front end adjacent the flat feed, for receiving the tape and dispensing the tape in a folded configuration.

In a specific aspect, a clip is coupled to and extends substantially a width of the spool, terminating in a raised lip, and movable between a retaining position in which the clip is normally biased radially outwardly, and a loading position in which the clip is moved radially inwardly against the bias.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 2:
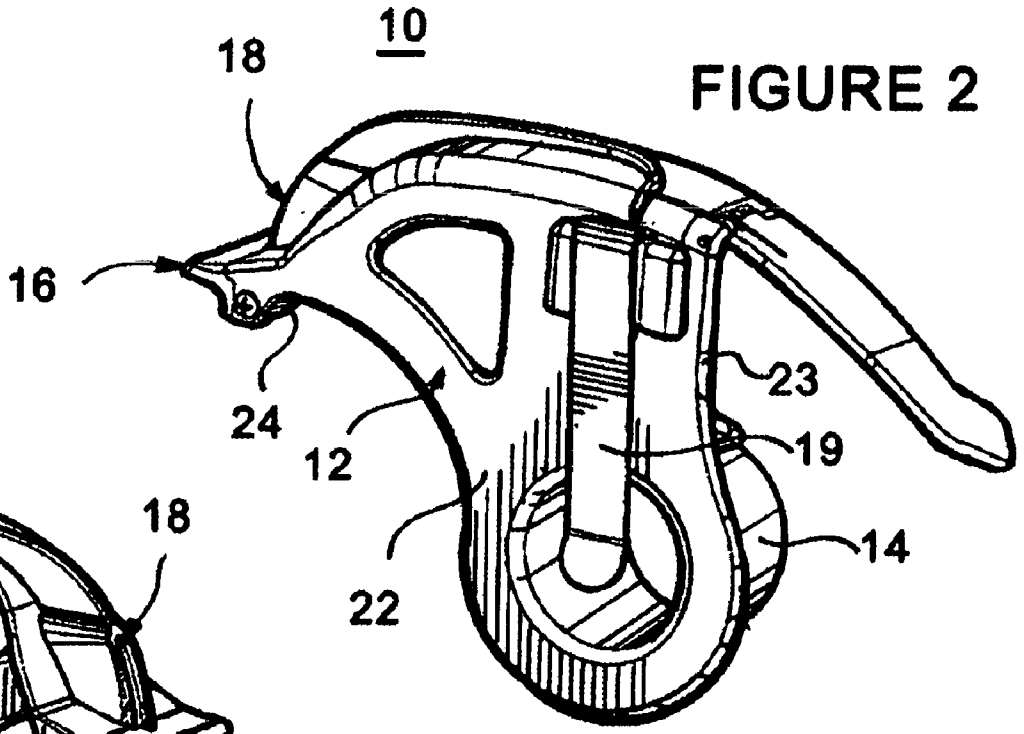
FIG. 2 is a perspective view illustrating the opposing side of the tape dispenser of FIG. 1.
Figure 1:
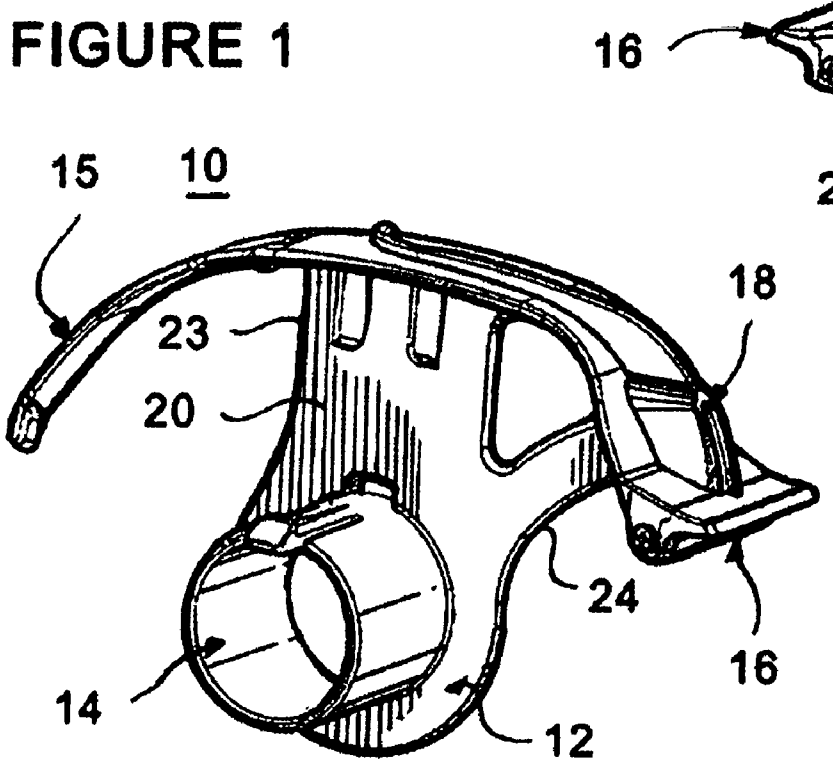
FIG. 1 is a perspective view illustrating a tape dispenser according to the present invention.

Turning now to the drawings in which like reference characters indicate corresponding elements throughout the several views, attention is first directed to FIGS. 1 and 2 which illustrate a tape dispenser generally designated 10. Dispenser 10 includes a frame 12 carrying a spool 14, a retaining arm 15, a flat feed 16, and a corner feed 18. A belt clip 19 can be added to provide a handy carrying capability and one handed operation. Frame 12 includes an inner side 20, an outer side 22, a back end 23 and a front end 24.

Figure 3:
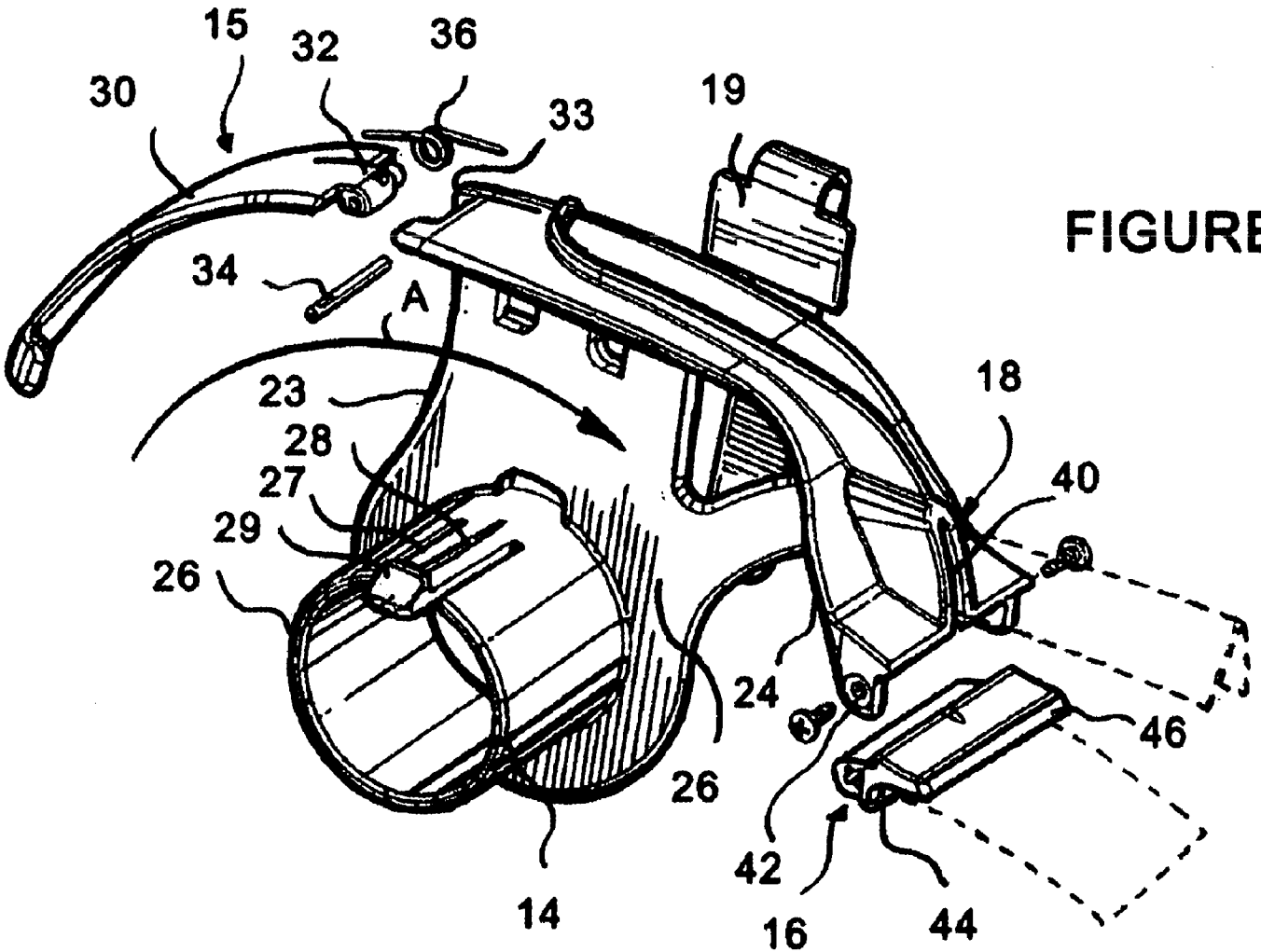
FIG. 3 is an exploded perspective view illustrating tape dispenser of FIGS. 1 and 2.
Figure 4:
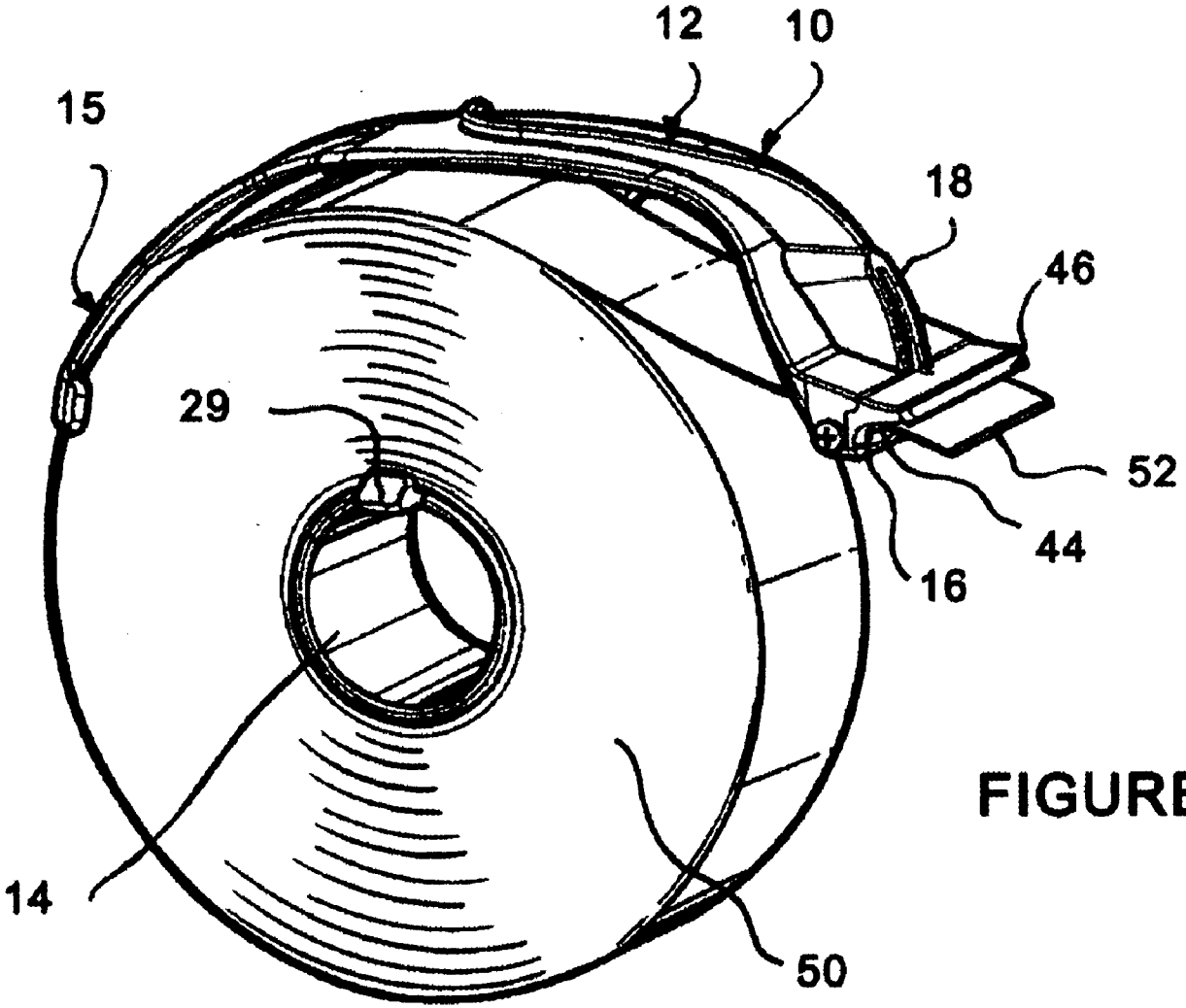
FIG. 4 is a perspective view of the tape dispenser of FIG. 1, as it would appear dispensing tape in a flat configuration.

With additional reference to FIG. 3, spool 14 extends from inner side 20 of frame 12 terminating in a rim 26. Spool 14 includes a clip 27 extending along the width of spool 14 from proximate frame 12 and terminating in a raised lip 29 proximate rim 26. Clip 27 also includes a resistance rib 28 extending along its length and terminating at raised lip 29 to prevent a tape roll from back-lashing when pulled quickly. As can be seen with reference to FIGS. 4 and 5, a roll of tape can be slipped over rim 26 and onto spool 14 by pressing clip 27 radially inwardly to a loading position. Once the roll of tape passes raised lip 29, clip 27 is allowed to bias back to its original or retaining position. In the outwardly biased position (retaining position), raised lip 29 prevents the roll of tape from inadvertently falling off spool 14. In this embodiment, clip 27 is molded integrally with spool 14, with an inherent outward bias. One skilled in the art will understand that a separate clip can be employed with biasing elements such as springs, etc. to hold the clip in the outward or retaining position.

Still referring to FIGS. 1–3, retaining arm 15 extends from back end 23 of frame 12. Retaining arm 15 includes a generally elongated arcuate member 30 having an end 32 coupled to back end 23. A clevis 33 is formed in back end 23 for receiving end 32. A pin 34 is journalled concurrently through apertures formed in clevis 33 and end 32. A coil spring 36 intermediate end 32 and back end 23, biasing elongated arcuate member 30 inwardly with respect to a tape path generally designated by arcuate line A, toward spool 14 and against the roll of tape. Tape path A is the path the tape takes between the roll of tape and the top of frame 12 on its way to flat feed 16 or corner feed 18. Retaining arm 15 restrains the roll of tape and keeps tape carried on spool 14 from unraveling, allowing tape to be constantly fed through flat feed 16 or corner feed 18.

Figure 5:
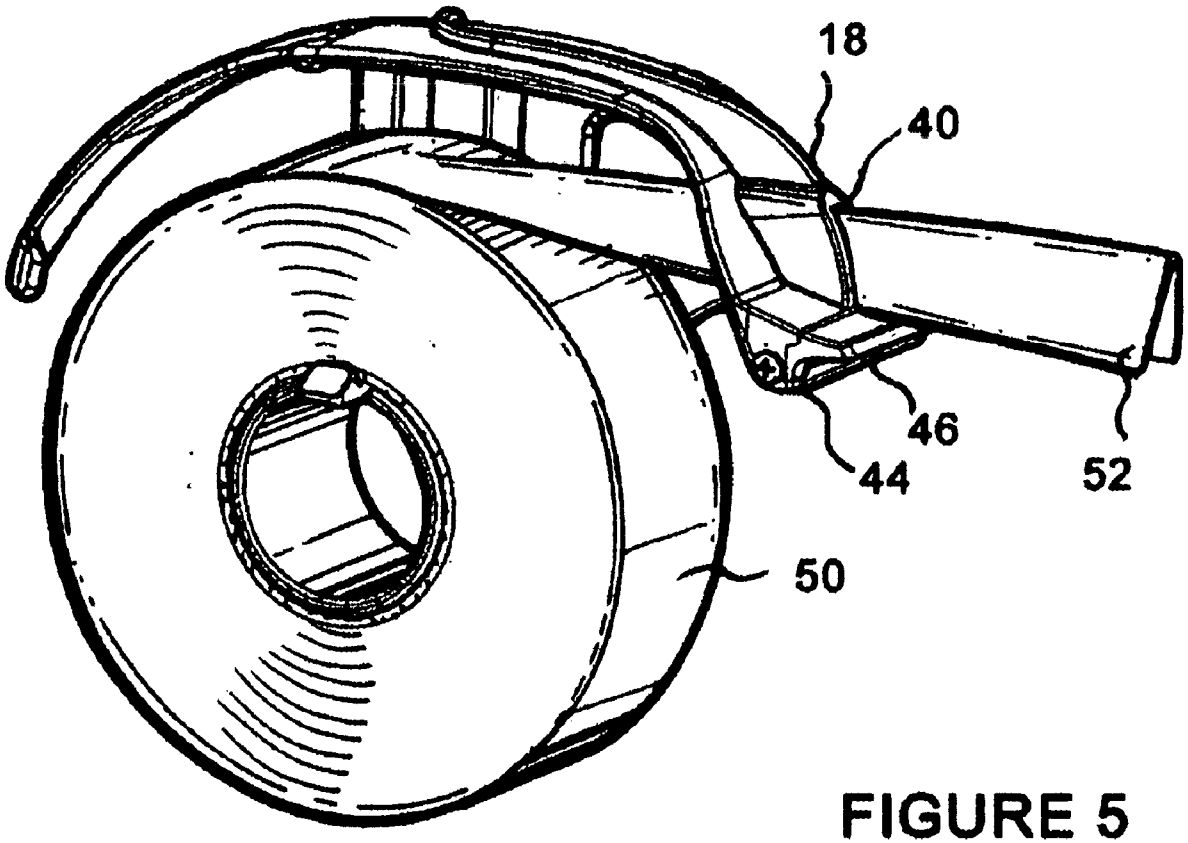
FIG. 5 is a perspective view of the tape dispenser of FIG. 1, as it would appear dispensing tape in a corner configuration.

Flat feed 16 and corner feed 18 are located at front end 24 of frame 12, and are the termination of tape path A. Corner feed 18 includes a vertical slot 40 formed in front end 24. Slot 40 is open at the bottom and widens into a bifurcated bracket 42. Flat feed 18 is coupled to bifurcated bracket and positioned below vertical slot 40. Flat feed 18 includes a horizontal slot 44 bounded on the top by a cutting blade or edge 46. With momentary reference to FIG. 4, a tape roll 50 is carried by spool 14. An end 52 of the tape is passed through horizontal slot 44. As the desired length of tape is dispensed in a flat configuration, the length is cut by pulling the tape against cutting edge 46. In this manner, a flat length of tape is dispensed. Referring now to FIG. 5, if a corner is to be taped, end 52 of the tape is passed through vertical slot 40 which folds the tape at the crease as it is dispensed. In this manner the tape is dispensed in a folded configuration for use on corners.

Referring back to FIGS. 1–3, belt clip 19 is coupled to outer side 22 of frame 12 and allows tool 10 to be firmly held in position at an individual's waist while the tape is dispensed with one hand. Thus, tape dispensing can be accomplished one handed.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A tape dispenser for receiving a roll of tape and dispensing tape therefrom, comprising:

a frame having an inner side, an outer side, a back end and a front end;

a spool carried by the frame intermediate the back end and the front end, the spool extending from the inner side and terminating in a rim;

a clip coupled to and extending substantially a width of the spool, terminating in a raised lip, and movable between a retaining position in which the clip is normally biased radially outwardly, and a loading position in which the clip is moved radially inwardly against the bias;

a retaining arm coupled to the back end of the frame and biased toward the spool for restraining the roll of tape;

a flat feed carried by the frame at the front end for receiving the tape and dispensing the tape in a flat configuration;

a corner feed carried by the frame at the front end adjacent the flat feed, for receiving the tape and dispensing the tape in a folded configuration, and a cutting element carried by the frame proximate the front end and separating the flat feed from the corner feed.

2. A tape dispenser as claimed in claim 1 wherein the flat feed includes a horizontal slot formed in the front end of the frame.

3. A tape dispenser as claimed in claim 1 wherein the corner feed includes a vertical slot formed in the front end of the frame.

4. A tape dispenser comprising:

a frame having a back end and a front end;

a spool carried by the frame intermediate the back end and the front end;

a roll of tape carried by the spool and having an end;

a retaining arm coupled to the back end of the frame and biased against and restraining the roll of tape;

a flat feed carried by the frame at the front end for receiving the end of the roll of tape and dispensing the tape in a flat configuration;

a corner feed carried by the frame at the front end adjacent to and separated from the flat feed, for receiving the end of the roll of tape and dispensing the tape in a folded configuration; and a cutting element carried by the frame proximate the front end and separating the flat feed from the corner feed.

5. A tape dispenser as claimed in claim 4 wherein the flat feed includes a horizontal slot formed in the front end of the frame.

6. A tape dispenser as claimed in claim 4 wherein the corner feed includes a vertical slot formed in the front end of the frame.

7. A tape dispenser as claimed in claim 4 further including a clip coupled to and extending substantially a width of the spool, terminating in a raised lip, and movable between a retaining position in which the clip is normally biased radially outwardly, and a loading position in which the clip is moved radially inwardly against the bias.

* * * * *